US005949836A

United States Patent [19]

Lidsky et al.

[11] Patent Number: 5,949,836

[45] Date of Patent: Sep. 7, 1999

[54] PRODUCTION OF RADIOISOTOPES WITH A HIGH SPECIFIC ACTIVITY BY ISOTOPIC CONVERSION

[75] Inventors: Lawrence M. Lidsky, Newton; Richard Lanza, Brookline, both of Mass.

[73] Assignee: Massachusetts Institute of Technology, Cambridge, Mass.

[21] Appl. No.: 09/075,808

[22] Filed: May 11, 1998

Related U.S. Application Data

[62] Division of application No. 08/525,854, Sep. 8, 1995, Pat. No. 5,784,423.

[51] Int. Cl.[6] ..... G21G 1/12

[52] U.S. Cl. ..... 376/156

[58] Field of Search ..... 376/146, 156, 376/157, 186

[56] References Cited

U.S. PATENT DOCUMENTS

| | | | |
|---|---|---|---|
| 3,378,447 | 4/1968 | Mittelman | 376/158 |
| 3,963,934 | 6/1976 | Ormrod | 250/499 |
| 3,999,096 | 12/1976 | Funk et al. | 313/330 |
| 4,123,498 | 10/1978 | Rosenbaum et al. | 423/2 |
| 4,428,902 | 1/1984 | Murray | 376/156 |
| 4,598,415 | 7/1986 | Luccio et al. | 378/119 |
| 4,701,308 | 10/1987 | Koehly et al. | 423/2 |
| 4,839,133 | 6/1989 | Vandergrift et al. | 376/186 |
| 4,935,194 | 6/1990 | Verschoore | 376/108 |
| 5,029,195 | 7/1991 | Danos | 378/121 |

FOREIGN PATENT DOCUMENTS 0 105 032 4/1984 European Pat. Off. .

OTHER PUBLICATIONS

Davydov, M.G. and Mareskin, S.A., "Preparation of $^{99}$Mo and $^{99m}$Tc in Electron Accelerators," *Radiokhimiya,* 35(5):91–96 (1993).

Domanov, E.E., et al., "Bremsstrahlung Converter with Increased Quantum Yield at < 100 keV," *Pribory i Technika Éksperimenta,* 2:43–46 (1991).

Nordell, B., "Production of $^{11}$C by Photonuclear Reactions," *Int. J. Appl. Radiat. Isot.,* 35(6):455–458 (1984).

Seltzer, S.M., et al., "Bremsstrahlung Beams from High–Power Electron Accelerators for Use in Radiation Processing," *IEEE Transactions on Nuclear Science,* NS–30(2):1629–1633 (1983).

Brinkman, G.A., "Isotope Production with Bremsstrahlung Beams in Comparison with Proton Beams," *International Journal of Applied Radiation and Isotopes,* 31:85–90 (1980).

Radna, Z., et al., "Possibility of radionuclide production by photonuclear reactions on microtrons," *Institute of Electrical Engineers, Stevanage, G.B., Abstract, JAD.ENERG.,* 34(10):365–368 (1988) Czechoslovakia.

Liuzzi et al., "A comparison of measured primary x–ray spectra from molybdenum and tungsten targets . . . " *Institute of Electrical Engineers, Stevenage, GB, Abstract, and 15th Annual Meeting of the American Associate of Physicist in Medicine,* 19(2) :258 (Jul. 29, 1973 to Aug. 8, 1973).

Malinin et al., "Production of radionuclides by photonuclear reactions," *Institute of Electrical Engineers, Stevenage, GB, Abstract & Radiochem. Radioanal. Lett.,* 53 (5–6) :311–318 (1982).

*Primary Examiner*—Daniel D. Wasil

*Attorney, Agent, or Firm*—Hamilton, Brook, Smith & Reynolds, P.C.

[57] ABSTRACT

An apparatus, and method, are disclosed for producing a high specific activity of a radioisotope in a single increment of target material, or sequentially within in-series increments of target material, by exposing a targeted isotope in the target material to a high energy photon beam to isotopically convert the targeted isotope. In particular, this invention is used to produce a high specific activity of $Mo^{99}$, of at least 1.0 Ci/gm or preferably at least about 10.0 Ci/gm, from $Mol^{100}$.

16 Claims, 8 Drawing Sheets

PRODUCTION OF RADIOISOTOPES WITH A HIGH SPECIFIC ACTIVITY BY ISOTOPIC CONVERSION

RELATED APPLICATION

This application is a Divisional of Ser. No. 08/525,854, filed Sep. 8, 1995, now U.S. Pat. No. 5,784,423, the entire teachings of which are incorporated herein by reference.

BACKGROUND OF THE INVENTION

Radioactive isotopes are widely used in industry, medicine and the life sciences. The utility and commercial value of a radioisotope are determined based upon specific activity, with a high specific activity having greater utility and value.

Currently, isotopes are produced by electron beams, ion beams, and nuclear reactors. Electron beams are now generally used to produce short-lived isotopes at locations near the site of use. Ion beams and reactors are generally used to produce longer-lived isotopes at central facilities.

Many isotopes are amenable to production by all three techniques. These include isotopes prepared by either the addition or removal of a neutron from a naturally occurring targeted isotope. Currently, the ion beam has been the method of choice for neutron removal because of its relatively high energy efficiency. However, the ion beam process is disadvantaged by its high initial cost, complexity of operation, and limited ability to be scaled to large production rates. In addition, the relatively heavy mass of the ions makes it very difficult to generate high current density beams. Furthermore, because the ion energy is deposited in a very short distance, thus causing intense local target heating, the beam cannot be sharply focused without destroying the target. This limits the average specific activity achievable by ion beams.

Electron beams have significantly longer stopping distances than do ion beams, however, electron beams must generate photons within the target before the radioisotope can be formed. Further, high electron beam power density, required to generate the photon intensity needed to produce a high specific activity of radioisotope, will typically impose unacceptably high heat loads upon a target material, resulting in target melting.

Fission reactors compete with the beam sources in the production of isotopes through neutron absorption processes and also have a unique role in the production of isotopes separated from fission products. Fission reactors are the method of choice for neutron addition because of their ability to produce large quantities of product. However, nuclear reactors are extremely expensive, have very high operating costs and are subject to exceedingly stringent siting and operational constraints under Federal regulations.

Therefore, a need exists for a less expensive and less complex means for producing high specific activities of longer-lived radioactive isotopes.

SUMMARY OF THE INVENTION

This invention relates to an apparatus, and method, for producing a high specific activity of a radioisotope in a single increment of target material, or sequentially within in-series increments of target material. In particular, this invention relates to an apparatus and method for producing a high specific activity of molybdenum-99 ($Mo^{99}$) by exposing $Mo^{100}$ to a high energy, high intensity photon beam, typically with an intensity of about 50 microamps/$cm^2$, or more. In producing a high specific activity of $Mo^{99}$, the product of f·R is at least $2.2\times10^{-8}$ $sec^{1}$, where f is the isotopic fraction of $Mo^{100}$ in the target and R is the photon path length per unit volume per unit energy, weighted by the photoneutron cross-section integrated over energy. An average specific activity of $Mo^{99}$ of at least 1.0 curie/gram can be obtained in molybdenum targets of up to 7.5 cm in thickness. Further, for molybdenum targets of up to 0.5 cm in thickness, an average specific activity of $Mo^{99}$ of 10.0 curies/gram can be obtained.

One embodiment of the apparatus of this invention includes an electron accelerator, a convertor for converting an electron beam into a high energy photon beam, and a targeted isotope which is contained in the target material. Optionally, the convertor includes at least two separate convertor plates, wherein the convertor plates have different thicknesses, and coolant channels disposed between adjacent convertor plates for cooling the convertor plates to remove heat generated by the electron beam.

In preferred embodiments of the invention, a concentration of at least one product isotope is sequentially produced within in-series increments of target material. A target assembly contains increments of target material which include the targeted isotope. The increment proximal to the beam source is removable, with radioisotope, from the target assembly, while leaving additional target material for radioisotope production. This apparatus can further include a means for moving increments, in series, toward the photon beam source as the proximal increment is removed from the target assembly. Optionally, this apparatus also includes a means for inserting an additional target material increment into the target assembly distal to the photon beam source.

A target material of the present invention can be a solid mass or selected from the group consisting of a liquid, a slurry or particles. In one embodiment of the apparatus, each increment of target material is separately contained within a container.

The method of invention for producing a high specific activity of a radioisotope, preferably $Mo^{99}$, in a target material containing a targeted isotope, such as $Mo^{100}$, includes exposing the target material to a high energy photon beam to form a high specific activity of within the target material. Typically, the intensity of the photon beam is 50 microamps/$cm^2$, or more. Further, in producing a high specific activity of $Mo^{99}$, the product of f·R is at least $2.2\times10^{-8}$ $sec^{-1}$. In one embodiment the thickness of the target material is about 7.5 centimeters, or less, and convertor is a tungsten convertor, wherein the electron beam power density is about 35,000 watts/$cm^3$.

In another embodiment of the method of this invention, the method further includes directing the photon beam from a photon beam source through target material increments, wherein the increments are in-series to said photon beam. This method optionally includes the step of advancing the target material increments in series toward the photon beam source. This method can further include the step of removing a target material increment from the photon beam, wherein the increment is proximal to the photon beam source.

The advantages of this invention include the highly efficient production of radioisotopes using a high energy electron beam to produce a commercially desirable specific activity level of a radioisotope within an increment of a target material. As the desired specific activity is produced in an increment of target material proximal to electron beam source, other increments of target material, in-series to the proximal increment, are sequentially pre-irradiated by the photon beam to commence building up the specific activity level of the radioisotope within each increment. Therefore, the period of time that an increment is irradiated, while proximal to the electron beam source, to produce a desired specific activity level of a radioisotope has been shortened by pre-irradiating the increment.

This invention also has the advantage that each increment of the target material can be removed to harvest radioisotopes without significantly affecting the overall production of the high specific activities in other in-series increments of target material.

An additional benefit of the present invention is that the target material is a source of intense neutron radiation. The neutron radiation can be used for further isotope generation by neutron absorption or other medical or industrial uses, such as imaging. Further, photons not absorbed by the target material can be employed in sterilization and materials processing.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
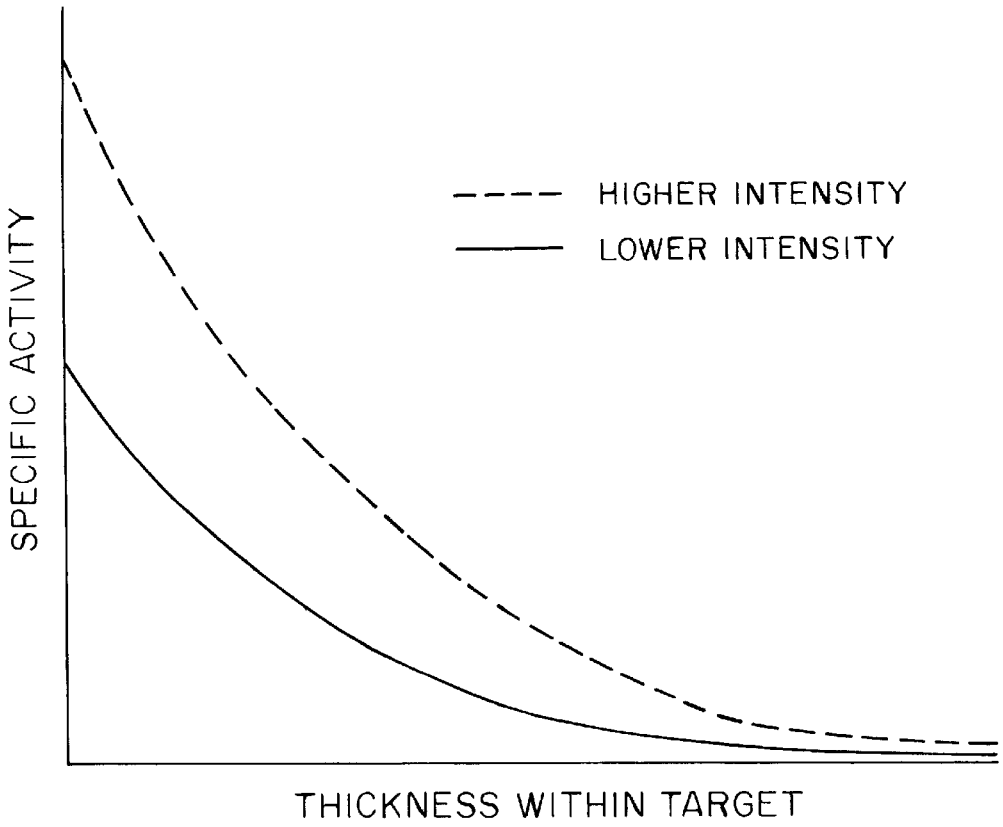
FIG. 1 is a plot of specific activity generated with a) a relatively higher intensity photon beam and b) a relatively lower intensity photon beam at different thicknesses within a target material.

The features and other details of the apparatus and method of the invention will now be more particularly described with reference to the accompanying drawings and pointed out in the claims. The same number present in different figures represents the same item. It will be understood that the particular embodiments of the invention are shown by way of illustration and not as limitations of the invention. The principle features of this invention can be employed in various embodiments without departing from the scope of the present invention.

The specific activity of a radioisotope, within a volume of target material, is the number of radioactive disintegrations per second of nuclides of the radioisotope (in curies (Ci)) measured per gram of the radioisotope's element, including all isotopes of the element, within the volume of target material. Specific activity provides an indication of the concentration of the radioisotope within the volume of target material. Typically, the specific activity is not uniform across a volume of target material, but is averaged across the volume of target material.

The level of specific activity, which constitutes a high specific activity, is dependent upon the radioisotope and its use. For example, wherein the radioisotope is molybdenum-99 ($Mo^{99}$), which subsequently decays to the daughter product technetium-99 ($Tc^{99}$), a high specific activity for $Mo^{99}$ is typically an average specific activity of about 0.5 Ci/gram of molybdenum, or more. Preferably, the specific activity of $Mo^{99}$ is about 1.0 Ci/gm, or more. More preferably, a high specific activity of $Mo^{99}$ is about 5 Ci/gram, or more. Even more preferably, a high specific activity of $Mo^{99}$ is about 10 Ci/gram, or more.

A radioisotope can be generated in a target material using high energy photons from a photon beam in at least one isotopic conversion reaction. A target material is a material which consists of or contains a targeted isotope, which when exposed to high energy photons, forms the radioisotope as a product. Typically, a targeted isotope has a high atomic number (Z), for example, a Z of about 30 or more.

A radioisotope product can be a final product, such as Cadmium-115 or Tantalum-179. Alternatively, a radioisotope product, such as Cadmium-109 or Osmium-191, can be an intermediate which subsequently decays to form a desired daughter product. Preferably, a radioisotope product is longer-lived. A longer-lived radioisotope, as defined herein, is a radioisotope with a half-life suitable to allow shipping and the subsequent use of the radioisotope, or a daughter product, after generating the radioisotope. Typically, a longer-lived isotope has a half-life of about 12 hours or more. Preferably, the half-life is about 48 hours or more. More preferably, the half-life is about 60 hours or more. Most preferably, the radioisotope product is $Mo^{99}$.

Suitable isotopic conversion reactions include, for example, (γ,n), (γ,2n), (γ,p) and (γ,pn) reactions.

An energy level, suitable for a high energy photon, is an energy level which is at least equal to the threshold (minimum) energy level, of the Giant Resonance region of the cross-section versus energy curve for the desired isotopic conversion reaction, required to produce the reaction between a photon and the targeted isotope.

The specific activity of a photon-beam generated radioisotope, within a volume of a target material, depends upon several variables, including the intensity (photon energy per unit area per unit time) of the high energy photons in the photon beam and the thickness of the target material. As shown in FIG. 1, the peak specific activity level, for a photon beam of any intensity, is at the target material surface irradiated by the photon beam. A photon beam with a higher intensity of high energy photons, irradiating the same target material, typically generates a higher peak specific activity than does a photon beam with a lower intensity of high energy photons.

A high intensity of high energy photons is an intensity sufficient to generate a high specific activity of a radioisotope. Typically, a suitable intensity of high energy photons is at least 50 microamps/cm$^2$ ($\mu$a/cm$^2$). Preferably, the intensity of high energy photons is at least 500 $\mu$a/cm$^2$. More preferably, the intensity of high energy photons is at least 1,000 $\mu$a/cm$^2$.

In addition, as also shown in FIG. 1, specific activity levels within the target material decrease exponentially with increasing depth along the thickness of the target material. The thickness of the target material is the distance from the irradiated side of the target material to the opposite face. Thus, the average specific activity of a radioisotope within a volume of target material increases with decreasing target material thickness.

The maximum specific activity (saturation activity) achievable by isotopic conversion in a volume of target material varies linearly with the production rate of the radioisotope. Typically, saturation activity is achieved only following irradiation periods that are significantly longer than the half-life of the radioisotope. Saturation activity (S) is calculated by the following equation:

$$S=1.62\times10^{13}\ f\cdot R/A$$

wherein f is the fraction of isotope of the targeted element which is targeted isotope and A is the atomic weight of the targeted element. R, which is indicative of the intensity of high energy photons, is the photon path length per unit volume and per unit energy ("$\phi(E)$") weighted by the photon cross-section ("$\sigma(E)$"), integrated over all photon energy levels. The specific formula for calculating the value of R is as follows:

$$R=\int\sigma(E)\cdot\phi(E)\cdot dE.$$

The photon energy levels included in the calculation of R may be limited to those in the Giant Resonance range as lower energy photons are not effective. Specifically, lower energy photons do not result in photonuclear conversion of $Mo^{100}$ to $Mo^{99}$.

Figure 2:
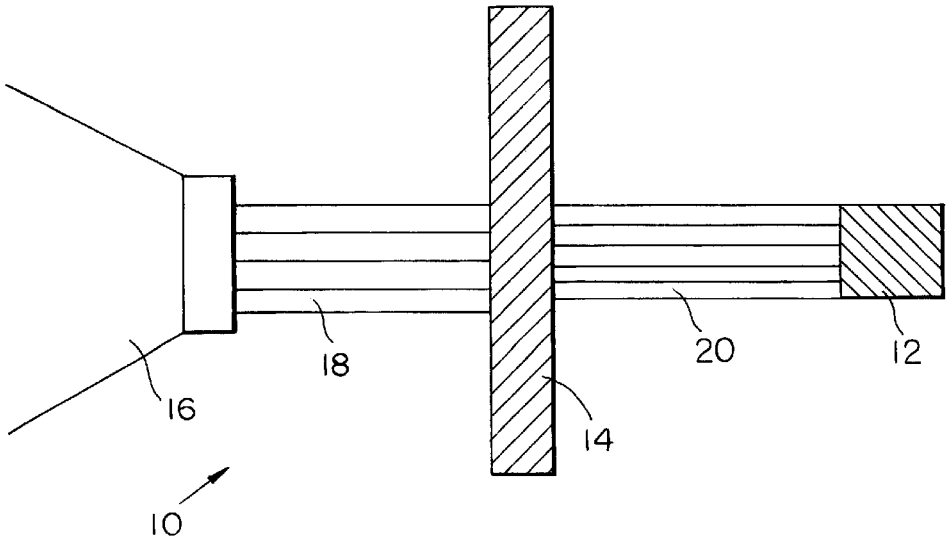
FIG. 2 is a sectional view of one embodiment of an apparatus, and method, of this invention for producing a high specific activity of a product radioisotope.

One embodiment, of the apparatus for producing a high specific activity of a product radioisotope in a volume of target material, is illustrated in FIG. 2. Apparatus 10 includes target material 12, convertor 14 and electron accelerator 16.

Target material 12 contains a loading of a targeted isotope which can be established based upon the intended isotopic conversion reaction and the concentration of product radioisotope desired. The specific isotopic conversion reactions occurring within target material 12 typically depend upon the desired product isotope and the availability of nuclei of the targeted isotope within target material 12. In one embodiment, the loading of a targeted isotope in target material 12 is at naturally occurring levels. Preferably, target material 12 contains enriched levels of the targeted isotope.

The targeted isotope can be in elemental form, in at least one compound (e.g., a salt or oxide), and/or complexed. The targeted isotope within the target material can be in any physical state, for example, a particulate, a liquid, in solution, in a suspension, in a slurry, or a in a larger solid mass.

Examples of other components optionally contained in target material 12 include materials in which the targeted isotope is retained, such as a metallic or ceramic material, or materials in which the targeted isotope is dispersed such as in a liquid (e.g., water or oils) or in particulates.

Apparatus 10 further includes electron beam 18 and photon beam 20. Electron beam 18 is generated by electron accelerator 16 and is directed into convertor 14, wherein photon beam 20, which includes high energy photons, is generated. Photon beam 20 radiates from convertor 14 into target material 12. Typically, photon beam 20 is a substantially collimated high energy photon beam.

A suitable convertor contains at least one high Z material, for example tungsten or platinum, which is refractory under the conditions of the method of invention. A high Z material is used to improve the efficiency of the conversion within convertor 14 of high energy electrons from electron beam 18 into high energy photons to form photon beam 20.

The total extent of convertor 14 in the direction of the trajectory of electron beam 18 should be sufficient to absorb a significant portion of the energy of electron beam 18 while transmitting photon radiation in an energy range suitable for the desired isotopic conversion reaction.

Concurrent with transforming the energy of electron beam 18 into high energy photons in photon beam 20, convertor 14 also shields target material 12 from any significant residual electron beam. If convertor 14 is too thick, photons emitted from convertor 14 will be degraded in energy due to passing through the material of convertor 14. If convertor 14 is too thin, significant levels of electrons will pass through convertor 14 and impinge upon target material 12. The preferred thickness of convertor 14, for obtaining optimum product isotope yield, depends on electron beam energy, the composition of convertor 14, and the Giant-Resonance region threshold energy of the targeted isotope. An example of an optimal convertor is a convertor containing approximately six plates of tungsten alloy of aggregate thickness 5 mm separated by cooling ducts for water cooling.

The intensity of high energy photons generated in convertor 14 is proportional to the power density (PD) of electron beam 18 in convertor 14. Thus, the specific activity of a radioisotope within a volume of target material 12 is also proportional to the power density. Power density within convertor 14 is calculatable by the following equation:

$$PD=E\times i/V$$

wherein E is the energy of electron beam 14, i is the current of electron beam 18 and V is the volume of convertor 14 through which electron beam 18 passes.

The power density used in this invention is limited by the heat removal capacity of convertor 14.

Figure 3:
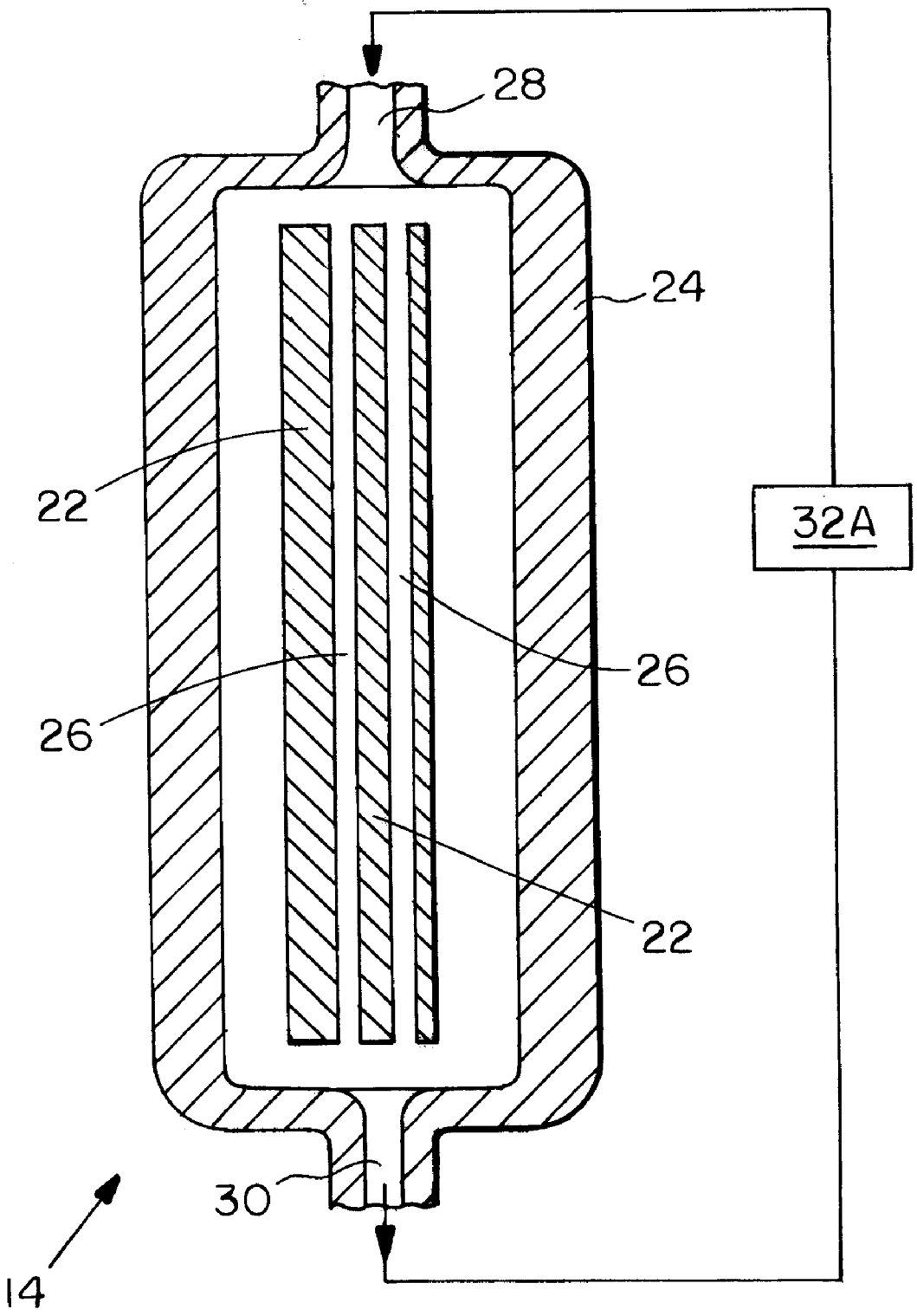
FIG. 3 is a sectional view of an alternative embodiment of a convertor used in an apparatus, and method, of this invention.

In another embodiment illustrated in FIG. 3, convertor 14 is composed of two or more plates 22 of high Z material, such as tungsten, instead of a single solid convertor to allow better heat removal from convertor 14 and thus, higher power densities of electron beam 18 therein. Plates 22 can be fabricated from the same or different material.

The plates are typically enclosed by external shell 24, which maintains the geometry of convertor 14 and also retains any optional coolant within convertor 14. In a preferred embodiment, plates 22 do not have equal thicknesses. The thicknesses of the plates is varied to equalize the heat loads on the plates. The heat load on each plate is derived from the energy transferred to the plate by electron beam 18 and by generated photons passing through each plate. Typically, the heat loads on plates distal to electron accelerator 16 are greater than the heat loads on proximal plates as electron beam 18 deposits energy in a plate after the electrons are slowed by previous plates. In addition, photons generated in the proximal plates can also deposit energy in subsequent, distal plates. Thus, in a more preferred embodiment, plates 22 proximal to electron accelerator 16 are thicker than plates 22 which are distal to the electron accelerator 16 to better equalize the heat generation in each plate 22. Plates 22 and cooling channels 26 in convertor 14 do not need to be perpendicular to the direction of electron beam 18. Preferably, the cross-sectional areas of convertor 14, or plates 22, are perpendicular to the path of electron beam 18.

Optionally, means are provided for removing heat from at least a portion of convertor 14. Heat removal is provided by typical means, such as by radiation, conduction and/or convection. Heat removal means are disposed around and/or through convertor 14. Examples of suitable heat removal means include coolant channels 26 which are disposed within the material forming convertor 14 (e.g., wherein the convertor material is a honeycomb), etched along the surface of convertor 14, etched along the surface of plates 22 and/or are disposed between plates 22. Alternatively, convertor 14 includes porous material in the form of frit wherein coolant flows through the interstices within the frit for heat removal.

Heat removal means also include convertor inlet 28 and convertor outlet 30, which are disposed at shell 24 of convertor 14.

Preferably, heat generated within convertor 14, or within each plate 22 of convertor 14, is removed by fluid coolant flow into convertor 14 through convertor inlet 28, through coolant channels 26 and out of convertor 14 through convertor outlet 30. Suitable means of fluid coolant flow include, for example, single-pass fluid flow, natural circulation and forced recirculation. Typically, outside of convertor 14, the coolant is then cooled, such as by being directed through heat exchanger 32A. Suitable fluid coolants include liquids, such as water or liquid gallium and gases, such as helium.

For very high power densities within convertor 14, such as greater than about 3 thousand watts/$cm^3$ or more, it is preferred that convertor 14 be a porous metallic frit which is cooled by fluid coolant flowing at high pressure through the pores, or interstices, within the frit.

In the embodiment wherein convertor 14 is tungsten and the targeted isotope is $Mo^{100}$, the optimum yield of a $Mo^{99}$ product isotope yield is when plates 22 of convertor 14 have a combined thickness slightly less than the stopping distance for an electron in electron beam 18.

When plates 22 have a combined thickness less than the electron stopping distance, backing 34 is disposed between convertor 14 and target material 12 to capture electrons without significantly degrading the energy of the photon beam. Suitable materials for backing 34 include lower Z metals such as aluminum. Typically, the high energy photon beam is directed through backing 34 at or near the center of backing 34. Further, the cross-sectional area of backing 34 is preferably equal to or larger than the width of high energy photon beam 18.

Optionally, backing 34 can be cooled by means for removing heat, not shown, such as heat transfer to a cooling medium (e.g., water).

Figure 4:
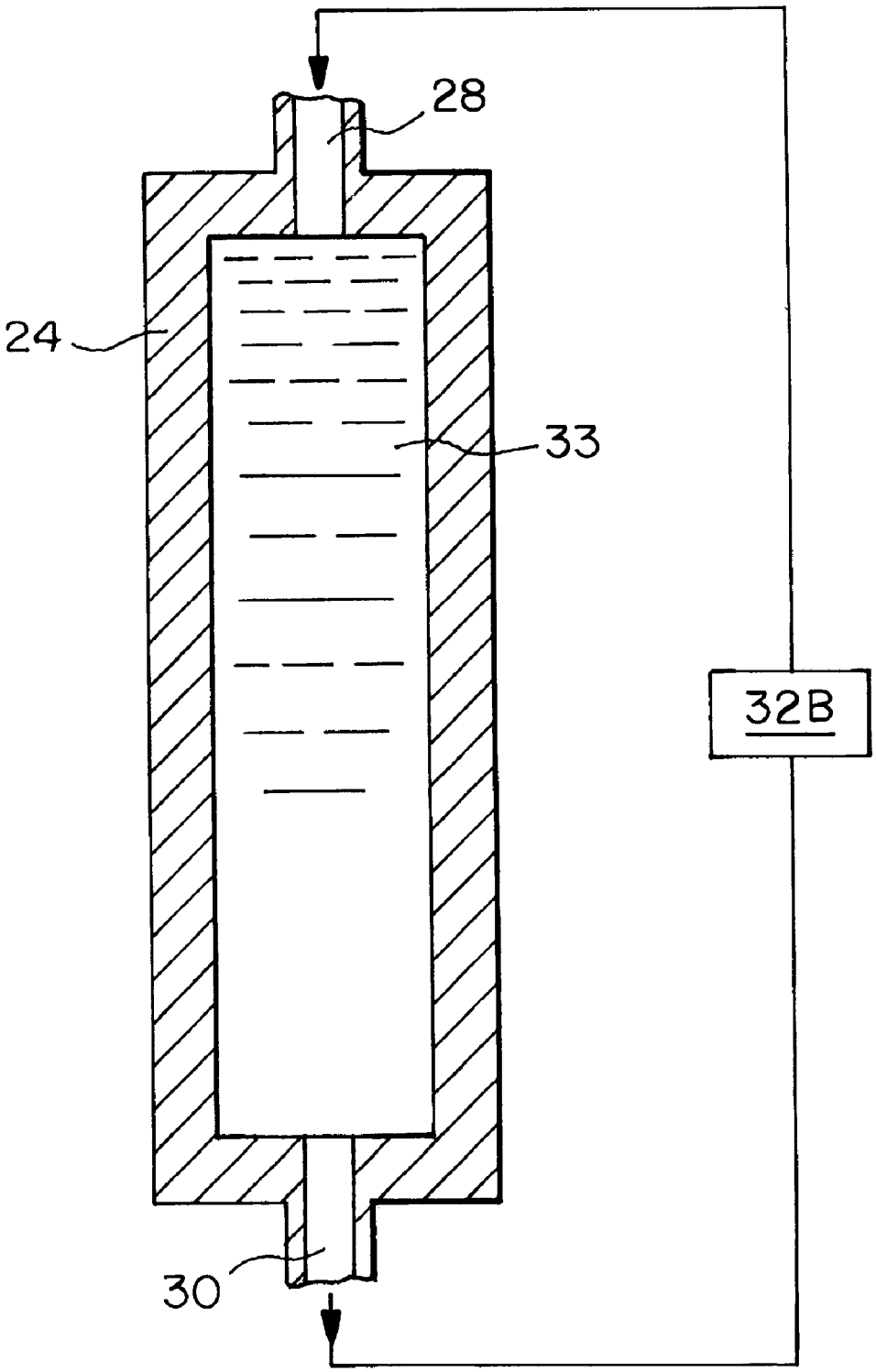
FIG. 4 is a sectional view of yet another embodiment of a convertor used in an apparatus, and method, of this invention.

In yet another embodiment illustrated in FIG. 4, convertor 14 consists of molten or liquified high Z material 33, which is recirculated from convertor inlet 28, through convertor 14, out of convertor outlet 30, through heat exchanger 32B, and subsequently back into convertor inlet 28. Heat generated in convertor material 33 within convertor 14 by the electron beam then dissipates, or is removed by suitable means, such as heat exchanger 32B, while the convertor material is outside of the convertor.

Figure 5:
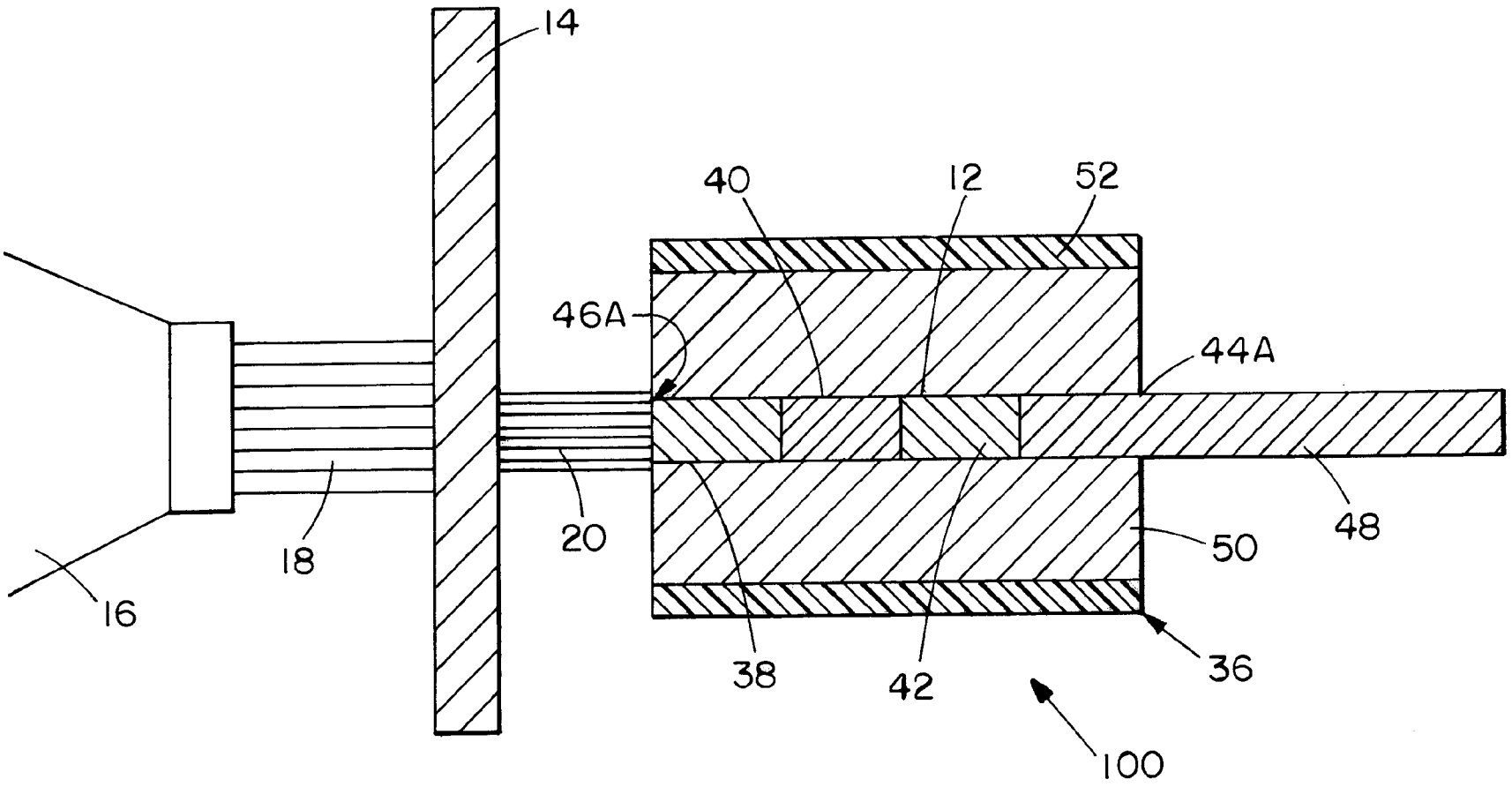
FIG. 5 is a sectional view of one embodiment of an apparatus, and method, of this invention for producing a high specific activity of product radioisotope in sequential targets.

FIG. 5 illustrates an alternative embodiment of the apparatus of this invention wherein separate, or separable, increments of target material 12 are irradiated in series thereby producing a high specific activity of radioisotope in the first increment and pre-irradiating the second increment to commence building up the concentration of the radioisotope within the increment. Apparatus 100 includes target assembly 36, convertor 14 and electron accelerator 16. Electron beam 18 is generated by electron accelerator 16 and is directed into convertor 14, wherein photon beam 20, which includes high energy photons, is generated. Photon beam 20 extends from convertor 14 into target assembly 36.

Target assembly 36 includes a target material which is separated or separable into at least two increments, with first target material increment 38 located proximal to convertor 14 and second target material increment 40 located adjacent to first target material increment 38 and distal to converter 14. Additional targets material increments 42 are disposed, in series, behind second target material increment 40. An increment of a target material is an amount of target material which is separate or separable from the target material contained within target assembly 12. Each increment of target material, such as first target material increment 38, second target material increment 40 and additional target material increments 42, contains a loading of a targeted isotope within the target material of the target. Typically, wherein the targeted isotope is contained within a larger solid mass, first target material increment 38 and second target material increment 40 consist of separate sections of the target material.

Target assembly 36 also includes inlet 44A and outlet 46A. Inlet 44A is disposed at or near the end of target assembly 36 distal to convertor 14. Inlet 44A is provided as a means for directing additional targets 21 into target assembly 36 on the distal side of second target material increment 40.

Outlet 46A is disposed at or near the end of target assembly 36 that is proximal to convertor 14. Outlet 46A is provided as a means for separating a distal target material increment from its adjacent target material increment (e.g., separating first target material increment 38 from second target material increment 40) by directing the distal target material increment out of target assembly 36 through outlet 46A.

Preferably, target assembly 36 also includes means, such as pushrod 48, for conveying increments of target material through target assembly 36 toward convertor 14, and then out of target assembly 36. Alternatively, other known means for non-destructively conveying target material can also be used to convey targets or target material through target assembly 36. Examples of other suitable conveying means include, for instance, conveyor belts, screws, pistons and pumps.

The target assembly 36 may further include photon reflector 50. Photon reflector 50 is disposed around at least a portion of target assembly 36. Photon reflector 50 is typically composed of high Z metals (e.g., a Z of about 30 or more), such as molybdenum-98, uranium, tantalum, tungsten, lead and other heavy metals. Photon reflector 50 reflects at least a portion of the high energy photons impinging the reflector material (e.g., from the incoming photon beam or scattered from the in-series target material increments) into the target material within target assembly 36.

Optionally, target assembly 36 includes neutron shielding 52 which is disposed at least partially around photon reflector 38. Suitable types of neutron shielding include shielding with a high hydrogen content, such as a plastic or water, which thermalizes and/or captures at least a portion of the neutrons emitted during an isotopic conversion reaction.

The depth of target material 12 through which photon beam 20 passes within the aggregate of in-series target material increments, disposed within target assembly 36 is determined based upon the loading of targeted isotopes within each increment, the desired concentration of product isotopes within each increment, the energy level of photon beam 20 and the period of irradiation. Preferably, the target material, contained in the in-series target material increments, has an aggregate thickness that results in the capture of all but an insignificant amount of high energy photons in photon beam 20 which impinge the target material and do not scatter outside of the target material. For example, wherein the targeted isotope is $Mo^{100}$ and the desired product is $Mo^{99}$, the aggregate thickness of the targets is typically between about 6 cm to about 10 cm for a photon beam produced by a tungsten convertor exposed to a 30–40 Mev electron beam.

The cross-sectional area of target material 12 within target assembly 36 perpendicular to photon beam 20 can be varied depending upon the focal area of photon beam 20 on target material increment 38 and the expected spread of the photon beam 20 along the path of photon beam 20 through target material 12. The cross-sectional area of target material 12 is usually about equal to, or larger than, the focal area of photon beam 20.

Figure 6:
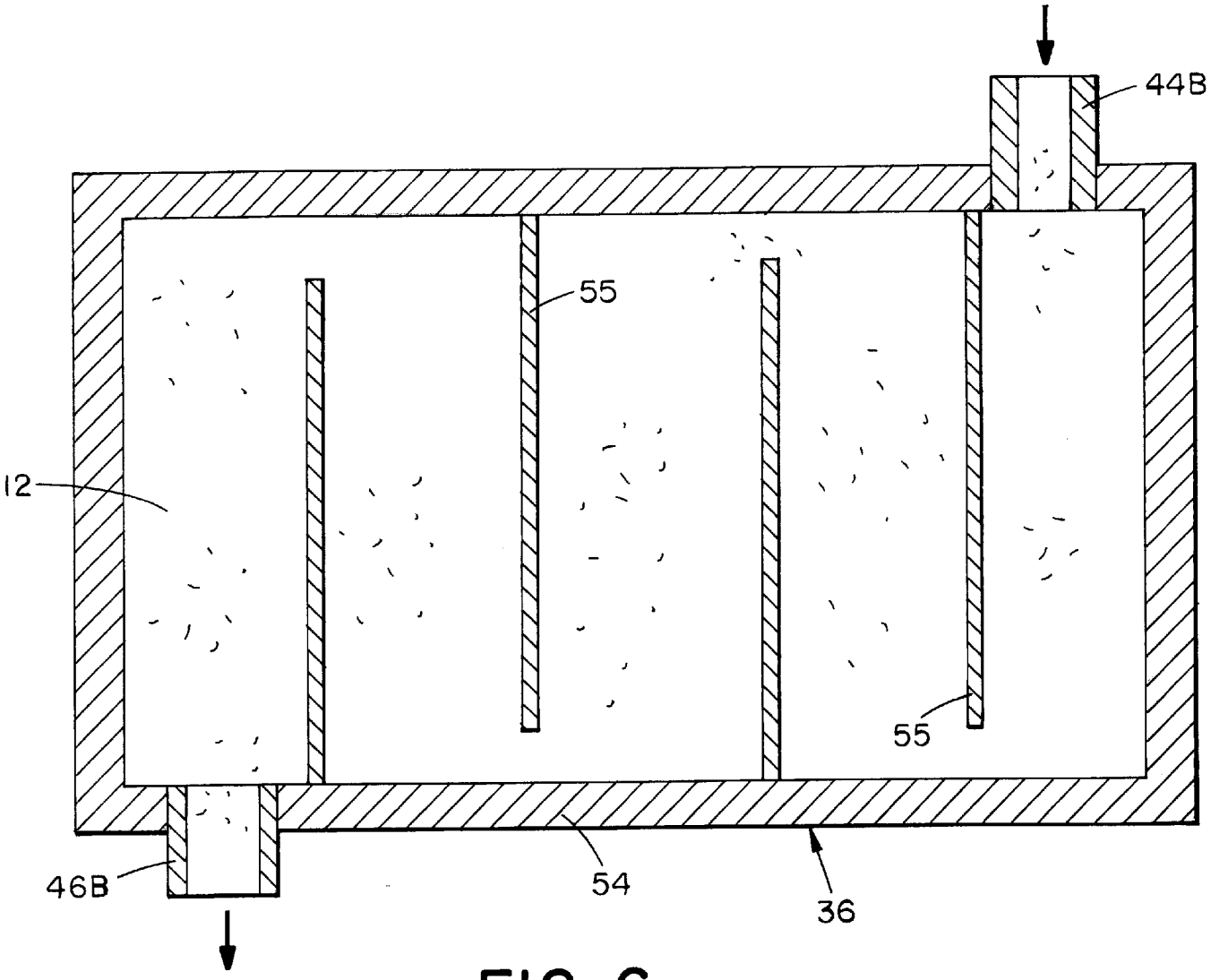
FIG. 6 is a sectional view of an alternative embodiment of a target assembly used in an apparatus, and method, of this invention.

In an alternative embodiment illustrated in FIG. 6, target material 12 is in a particulate, liquid, slurry or any other physical form wherein an increment of target material 12 is not contained in a single solid mass. Thus, increments of target material 12 are not separate but are separable. Target assembly 36 includes means for containing target material 12 within target assembly 36, such as cylinder 54 which is disposed within target assembly 36. Suitable containing means, include containers for solids and/or liquids, which are refractory, such as titanium. The material composition and structural design of the container should not result in a significant reduction in the energy of photon beam 20 or a significant increase in the scatter of photons from photon beam 20. Cylinder 54 includes baffles 55 which control the flow in cylinder 54 to assure generally uniform irradiation.

Target assembly 36 also includes means for directing increments of target material 12 through cylinder 54. This directing means includes inlet 44B and outlet 46B. Inlet 44B is disposed at or near the end of cylinder 54 distal to convertor 14. Outlet 46B is disposed at or near the end of cylinder 54 that is proximal to convertor 14. In this embodiment, target material 12, which is typically in liquid, slurry or particulate form, is directed into cylinder 54 through inlet 44B, moves towards and the proximal end of cylinder 54, and then comes out of cylinder 54 through outlet 46B. The movement (e.g., flow) of target material 12 through cylinder 54 can be continuous of intermittent. Suitable means to direct flow of target material 12 include, for example, pumps, pistons and gravity feeding. The flow of target material 12 through cylinder 54 can be controlled, for instance, by a valve or clamp located in a position suitable to stop flow (e.g., at inlet 44B or outlet 46B) and/or by controlling the flow directing means (e.g., starting and stopping a pump).

Figure 7:
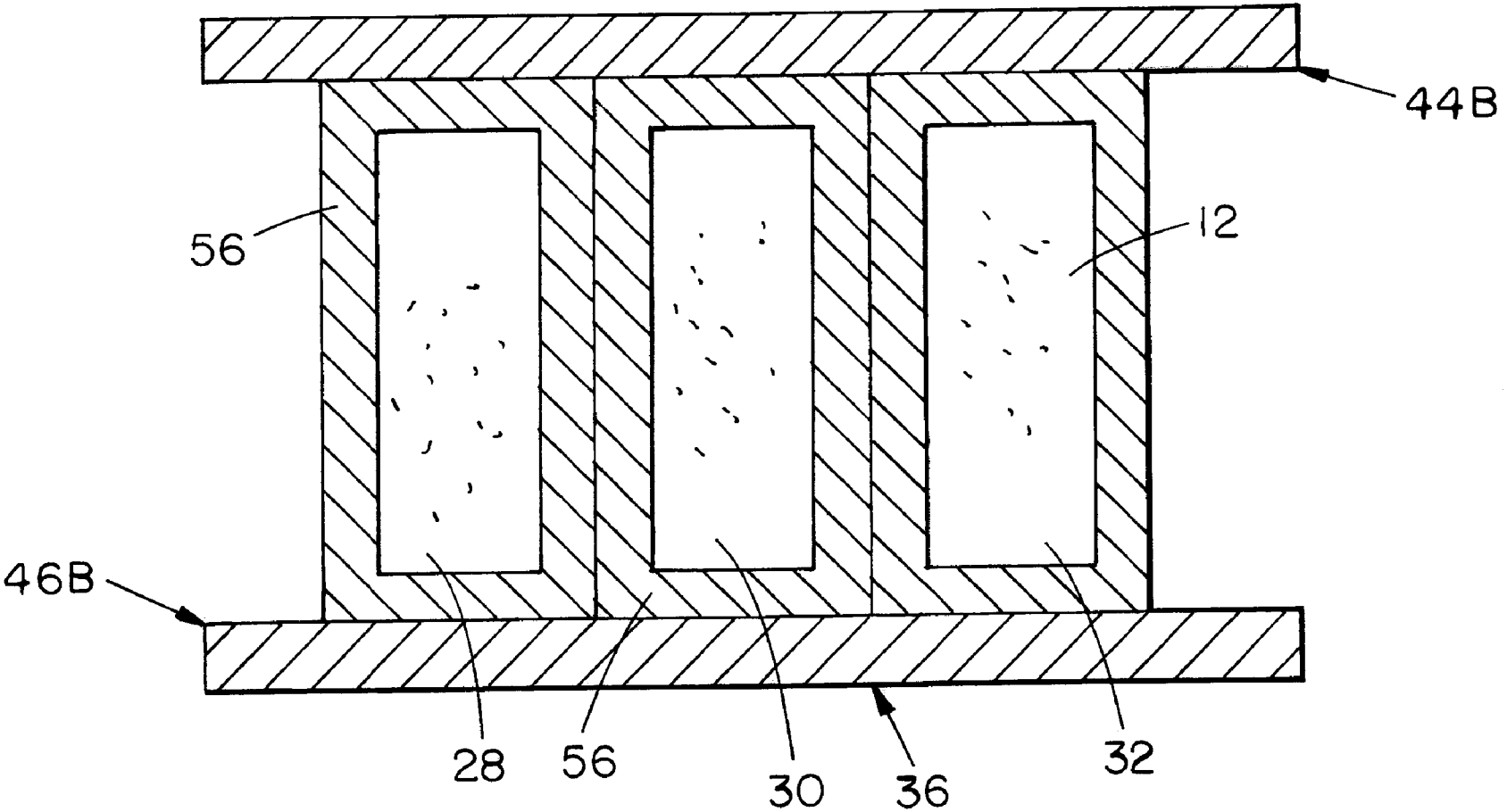
FIG. 7 is a sectional view of yet another embodiment of a target assembly used in an apparatus, and method, of this invention.

In another embodiment illustrated in FIG. 7, wherein the increments of target material 12 are separate, but not solid masses, target assembly 36 further includes means for separately containing each increment of target material 12. Typically, target material 12 is in a particulate, liquid or slurry form.

Suitable containing means, such as container 56, include containers which can contain a solid and/or liquid, wherein the container is refractory under the method of this invention. The material composition and structural design of the container should not result in a significant reduction in the energy of photon beam 20 or a significant increase in the scatter of photons from photon beam 20. An example of a suitable container material is titanium.

In this embodiment, containers 56 enter the distal end of target assembly 36 through inlet 44B, are directed toward the proximal end of target assembly 36 while concurrently being irradiated by photon beam 20, and then leave target assembly 36 through outlet 46B.

Operation of the embodiment of FIG. 2 for producing a high specific activity of a radioisotope will now be described. Electron accelerator 16 generates electron beam 18 which is directed into convertor 14. At least a portion of the electrons of electron beam 18 are captured in an (electron, $\gamma$) reaction by the high Z material of convertor 14 to generate photons, including high energy photons in photon beam 20. Typically, most electrons are captured and most photons pass through convertor 14.

Typically, electron accelerator 16 generates an electron beam 18 with an average energy level of about 25 MeV or more, preferably between about 30 MeV and about 50 MeV. The total power of electron beam 18 is limited by the design of electron accelerator 16 and by the design, thickness and heat removal capability of convertor 14. If the beam energy is too low, there will not be sufficient photons in the Giant Resonance region to produce a high specific activity of the radioisotope and the electron range in convertor 14 will be so short as to make heat removal from convertor 14 very difficult. If the beam energy is too high, many photons will have energies above the optimal range, direct electron heating of target material 12 will be a problem and electron accelerator 16 will be relatively expensive. In addition, increased production of impurities, such as niobium, can result for other isotopic conversion reactions.

Photon beam 20 is directed from convertor 14 and focused onto target material 12. Target material 12 is typically placed in close proximity to convertor 14 and in alignment with the exit of photon beam 20 from convertor 14. Sufficient distance between convertor 14 and target material 12 may be left to interpose material to attenuate electromagnetic fields to deflect electron beam 18 or to interpose material to modify the photon spectrum of photon beam 20, but this distance is minimized in order to use the photon beam at high intensity. If no attenuation is required, target material 12 may be in contact with convertor 14.

Within target material 12, at least a portion of the high energy photons of photon beam 20, react with the targeted isotope to form a concentration of a radioisotope within the target material by an isotopic conversion reaction, such as by ($\gamma$,n), ($\gamma$,2n), ($\gamma$,p) or ($\gamma$,pn) reaction.

Preferably, a significant number of the photons of photon beam 20 are high energy photons which have an energy level falling within the range of energy levels included in the Giant Resonance region of the cross-section versus energy curve for the desired isotopic conversion reaction. More preferably, a significant portion of the photons of photon beam 20 have energy levels about equal to the peak energy level of the Giant Resonance region.

For heavier materials, the energy levels corresponding to the Giant Resonance region are relatively lower while for lighter materials the energy levels are relatively higher.

Preferably, the energy of electron beam 18 should be about 2 to about 3 times the energy level of the peak of the Giant Resonance region of the targeted isotope. For example, in the (γ,n) isotopic conversion of $Mo^{100}$ to $Mo^{99}$ it is preferred that at least a significant portion of photons in photon beam 20 have energy levels falling within the Giant Resonance region for this reaction, specifically between the threshold energy level of about 10 MeV and the high energy limit of about 19 MeV. More preferably, photon energy levels are about 15 MeV, which is the peak of the Giant Resonance region. The electron beam energy for this isotopic conversion is typically between about 25 Mev to about 50 Mev, with a preferred energy range of about 35 Mev to about 40 MeV.

The energy level of a generated photon is directly dependent upon the energy level of electron beam 18, with the peak energy level of generated photons being equal to about the energy level of electron beam 18. Typically, most generated photons have energy levels at less than half the peak energy. Therefore, the energy level of at least a portion of the electrons in electron beam 18 at a minimum must be equal to the threshold (minimum) energy level required to produce the desired isotopic conversion reaction between a generated photon and the targeted isotope. Preferably, the energy level of electron beam 18 is within or above the Giant Resonance region of the desired isotopic conversion reaction.

In a preferred embodiment, wherein the targeted isotope is molybdenum-100 ($Mo^{100}$) which is isotopically converted to molybdenum-99 ($Mo^{99}$), which then decays to the desired daughter product technetium-99 ($Tc^{99}$), the photon beam produced includes γ radiation at an energy level of about 8 Mev or more. More preferably, a substantial amount of the γ radiation produced is at energy levels between about 8 Mev and about 16 MeV.

Achievement of an average specific activity of $Mo^{99}$ of about 1.0 Ci/gm of Mo in solid molybdenum requires a relatively high power density in convertor 14. Specifically, in the saturation activity equation, the product of f·R must have a value greater than about $2.2\times10^{-8}$ $sec^{-1}$. This value of R is difficult to achieve because of technical limitations on electron beam power density and convertor heat removal. Therefore, the volume in which the average specific activity of 1.0 Ci/gm can be maintained is typically limited to target material volumes having relatively small thicknesses. In determining the maximum volume of target material, the cross-sectional area of the target material usually must be equal to or less than the focal area of photon beam 20. Thus, target material volume is often limited to a few cubic centimeters or less.

For example, for a natural molybdenum target, containing approximately 10% $Mo^{100}$, a 35 Mev electron beam of 1.0 milliampere current focused onto a 1.0 cm radius target disk yields, with an optimal convertor, an average specific activity of about 1.0 Ci/gm for a target material thickness of about 0.5 cm. The power density in the active regions of the convertor would be about 35,000 watts/$cm^3$.

Higher specific activities can be achieved by isotopic enrichment of the target material. A target material enriched to 100% $Mo^{100}$ would yield a specific activity in excess of 10 Ci/gm up to a target material thickness of about 0.5 cm for the same conditions.

Molybdenum target thicknesses greater than 0.5 cm, having an average specific activity of at least 1.0 Ci/gm, can be obtained by varying the isotopic enrichment of $Mo^{100}$ in the target material and/or by varying the energy levels of the photons in the photon beam, providing the value of the product f·R is at least $2.2\times10^{-8}$ $sec^{1}$.

For a thick target, the activity produced in the first 0.5 cm depth of the target is only 28% of the total generated in the target. However, the other 72% of the desired product isotope is so diluted with unconverted target material as to be below commercial interest. On the other hand, to irradiate a single target of 0.5 cm thickness or less results in lost photon energy. The portion of the thick target with less than threshold activity represents a potentially valuable resource, unusable if unimproved.

Accordingly, by providing an incremental target as in FIG. 5, only that portion of the target which has been irradiated to an average specific activity above a given threshold value is removed for processing. Additional portions of the target, irradiated to less than the threshold value, can be sequentially irradiated to the threshold value in such fashion as to optimize the combination of specific activity of individual target elements and total radioisotope production rate. Preferably, each target increment is 0.5 cm thick or less.

Within, at least, first target material increment 38 and second target material increment 40, a portion of the high energy photons of photon beam 20, react with the targeted isotope to form a high specific activity in first target material increment 38 and pre-irradiate second target material increment 40, and possibly additional target material increments 42, to commence building up the specific activity of the radioisotope within these increments.

This method also includes moving first target material increment 38 and second target material increment 40 toward outlet 46A, and closer to convertor 14, by the action of push rod 48 applying force to the distal side of second target material increment 40 through additional target material increments 42. Alternately, the targets can be moved by any suitable automated or non-automated means. Further, the movement of targets can be continuous, concurrent, sequential or stepwise.

Ultimately, first target material increment 38 is pushed through outlet 46A and is removed from target assembly 36. Further second target material increment 40 is pushed to the original position of first target material increment 38 whereupon photon beam 20 then focuses upon second target material increment 40 to complete producing a high specific activity therein.

Additional target material increments 42 can be added in-series behind second target material increment 40 through inlet 44A.

In this method, the ratio of the specific activity of the product radioisotope in each increment to the amount of product isotope removed per unit time can be optimized depending upon the need for a high discharge rate of product radioisotope or a high specific activity of product radioisotope.

The concentration of the product radioisotope generated by the isotopic conversion reaction is dependent upon the intensity of the high energy photons in photon beam 20, upon the volume of target material 12 irradiated, upon the radioactive half-life of the product isotope, and upon the amount of target material 12 which is irradiated. The intensity of photons is approximately dependent linearly upon the current level of electron beam 18 for the same focal area, with higher currents generating more high energy photons per unit time, which then are directed into the target material to react with more targeted isotope per unit time.

The volume of target material 12 irradiated by photon beam 20 depends upon the focal area of photon beam 20 upon target material 12 and the amount of photon scatter within the target material. Typically, the focal area of photon beam 20 is a function of the angle of emission of high energy photons from convertor 14. Most higher energy photons, having an energy level which falls within the Giant Resonance region for the desired isotopic conversion reaction, are emitted in a narrow cone whose axis is aligned along the direction of an extended axis of electron beam 18. The intensity of higher energy photons, which are emitted at an angle to the axis of the cone, rapidly decreases as the angle from the cone increases. For instance, at an angle of about 5 degrees from the axis of the cone, the intensity of peak photons is about one fifth of the intensity of peak photons emitted about the center of the cone. In addition, the intensity of higher energy photons, having approximately one-half peak photon energy, is lower by about two orders of magnitude at an angle of 25 degrees from the axis of the cone than the intensity along the axis of the cone.

Thus, photon beam 20 is strongly peaked in the forward direction along an extended axis of electron beam 18. Therefore, the focal area of photon beam 20 is determined by the focal area of electron beam 18 on convertor 14. With increasing electron beam energies, the focal area of photon beam 20 becomes smaller with a minimum area being the size of the focal area of electron beam 18 on convertor 14. Thus, with increasing photon beam energies, the cross-sectional area of target material 12 is further limited.

To optimize the specific activity of product radioisotope in each target material increment, when removed from the target assembly, the focal width of photon beam 20 is minimized to produce a higher concentration of product radioisotope near the center of first target material increment 38 with lower concentrations near the edges of the target. As photon beam 20 travels through the target material and spreads, such as from scattering, the concentration is reduced near the center of the target material and is increased nearer to the edges of the target material 12. Thus, after passing through first target material increment 38, photon beam 20 will pre-irradiate second target material increment 40 and additional target material increments 42 to produce lower levels of product isotope throughout these incremental targets (e.g., near the centers and at the edges).

Preferably, the focal area of electron beam 18 is minimized to attain greater concentrations of product isotope near the centers of the targets. The lower limit on focal area of electron beam 18 on convertor 14 is dependent upon the heat dissipation capability of convertor 14. The focal area of electron beam 18 should not be so small as to create a high power density in the affected potion of convertor 14 which leads to localized melting, destruction and/or loss of function of the convertor material.

Figure 8:
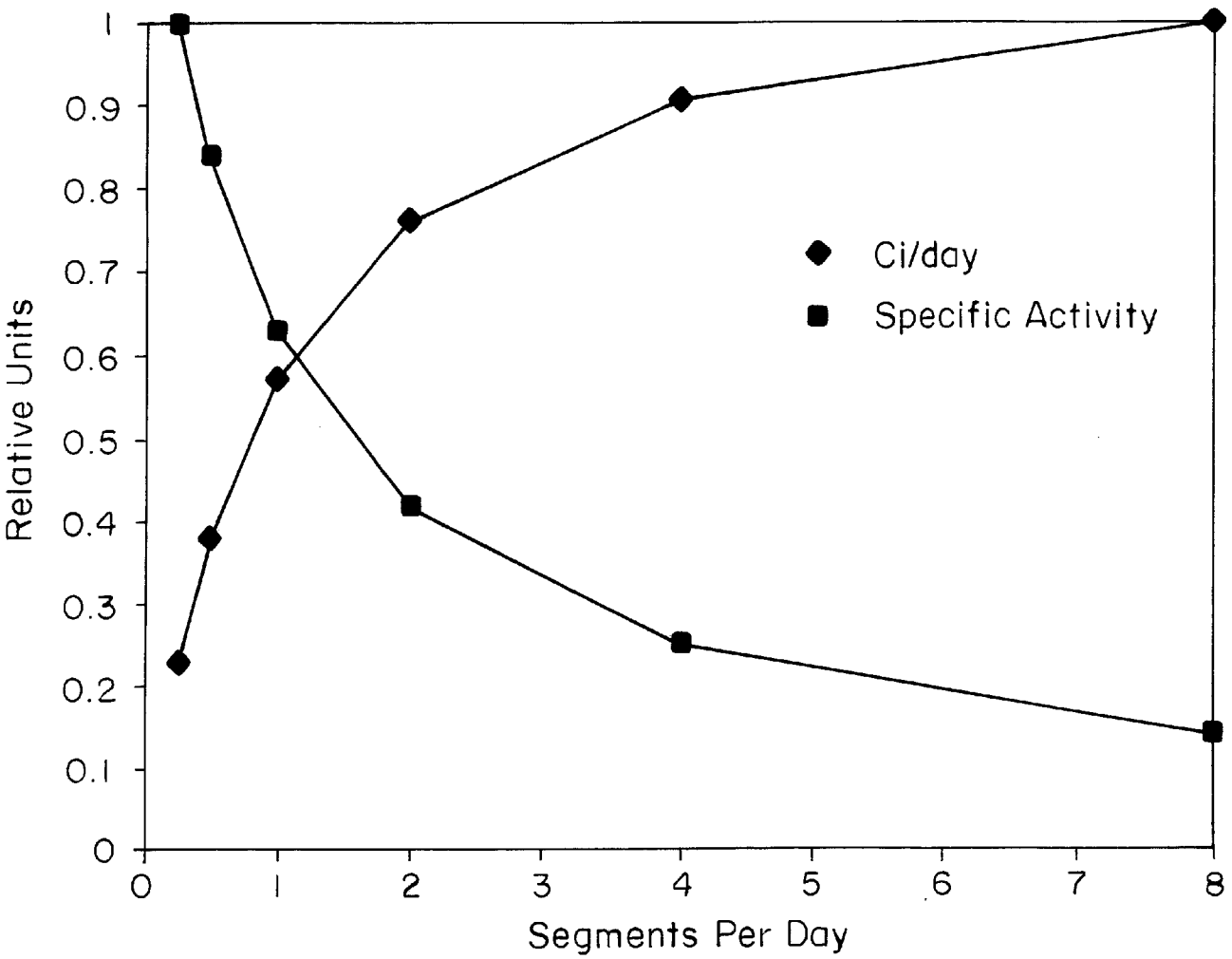
FIG. 8 is a theoretical plot of a) total curies removed per day from a target assembly and b) specific activity within a target, versus the time each target is irradiated as measured in target segments removed per day from a target assembly.

The amount of time a target is irradiated can depend upon the movement rate of the in-series target material increments, while in photon beam 20, toward outlet 46. Target material increments are introduced, moved and discharged at rate such that the combination of segment thickness and discharge rate yields a product of the desired specific activity of product isotope. A high discharge rate of targets will result in the recovery of a larger fraction of the generated radioisotope but the specific activity of the discharged material will not be as high as that which would result, all other factors remaining unchanged, from a low target material increment discharge rate. FIG. 8 further illustrates the calculated effect on production rate and specific-activity of product of varying the flow rate of target material within the photon beam. FIG. 8 is based upon an electron beam energy of 35 MeV, an electron beam current of 1.10 ma, and cylindrical $Mo^{100}$ target segments which are 2.0 cm in radius and 0.5 cm thick.

The method of this invention can also be employed to produce concentrations of stable isotopes.

The invention will now be further and specifically described by the following examples.

EXAMPLE 1

$Mo^{99}$ Production by Photonuclear Transmutation of $Mo^{100}$

A cylinder of molybdenum (4 inches diameter), having a natural isotopic abundance, was sliced in planes perpendicular to the length of the cylinder into separate foils and slabs of molybdenum. Each foil was followed by a separate slab. Each foil had a thickness of about 0.01 inch (0.25 mm), while each slab had a thickness between about 0.75 inches and about 1.5 inches. The foils were used to determine the specific activity of $Mo^{99}$ at different points within the aggregate thickness of the foils and slabs.

In the target, the six foil/slab units were situated in series, with the slabs closer to the γ beam source having the narrower widths. Each foil or slab was touching the adjacent slab or foil.

A 2 inch diameter, 4.3 mm thick tungsten slab, used as a convertor plate, was located between the γ beam source and the target. The convertor was also touching the first foil of the target.

A 28 MeV electron beam, having a current of 1.84 microamperes (μa) and a beam width of 1.5 cm, was directed substantially perpendicularly into the side of the convertor proximal to the electron beam source. A γ beam was generated, substantially perpendicular to the distal side of the convertor. The γ beam was directed into the target. The target was exposed for 4.6 hours to the generated γ beam generated.

Twenty-six hours after irradiation, the total activity of technetium-99 ($Tc^{99}$), and the Giant-Resonance beam half-width, were then measured for each foil using a calibrated intrinsic-germanium crystal, by measuring the amount of γs having an energy specific to $Tc^{99}$ decay (i.e., 140.1 keV) which were emitted at the center point of each foil, and by measuring the radial distance from the center of the foil over which the activity is reduced by one half to show beam spread.

Figure 9:
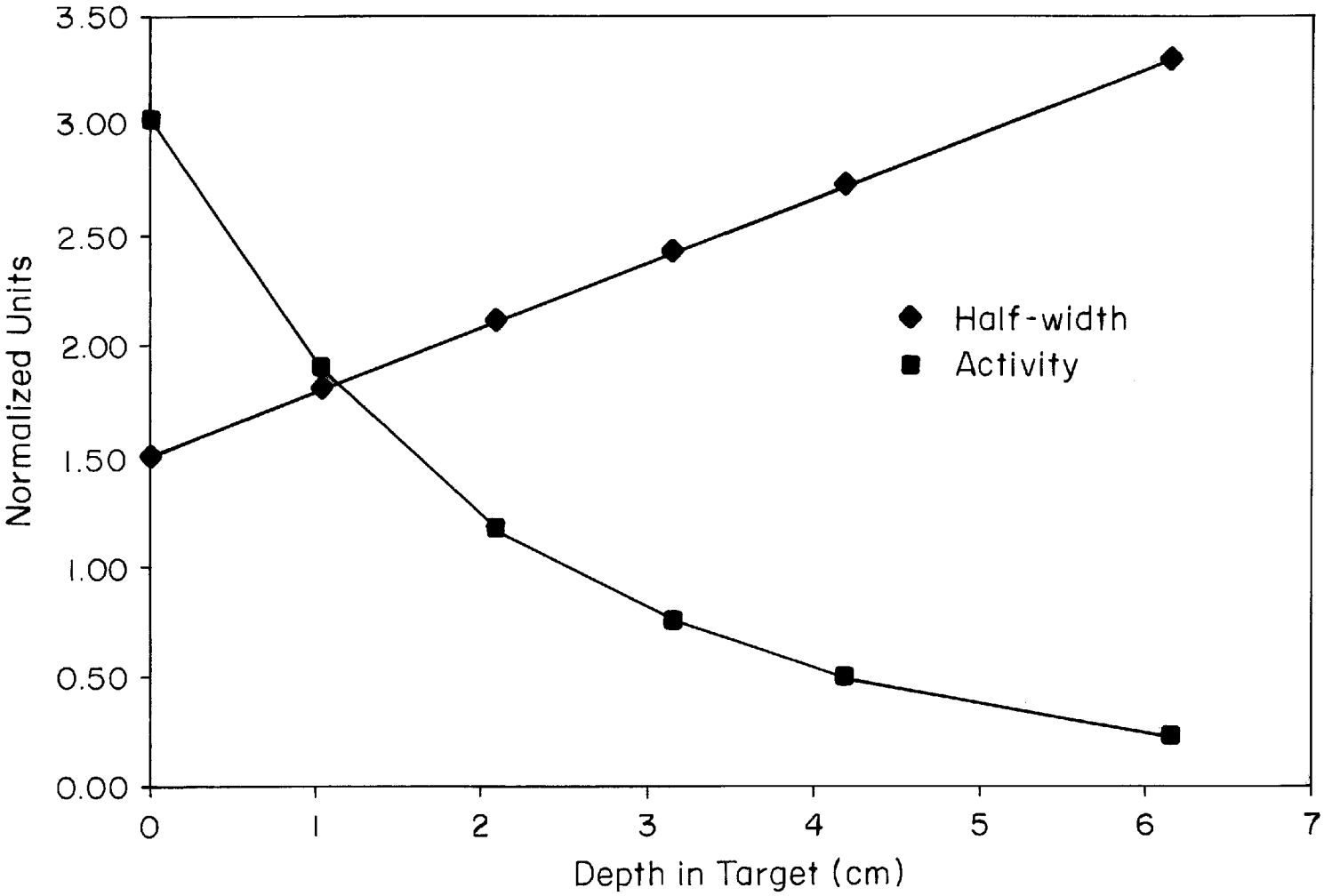
FIG. 9 is a plot of a) center point activity and b) activated region half-width, versus depth in a molybdenum target of Example 1.

The results of center point activity measurements for the six sequential foils are provided in FIG. 9. As shown therein, the activity of $Tc^{99}$ measured at the center point of the first foil, located at surface of the target (depth=0), was 30.3 microcurie (μCi). The center point activities for foils deeper in the target declined non-linearly as a function of their relative depths within the target. This demonstrates that the intensity of the photon flux in the Giant-Resonance energy range falls off quickly with distance in the target material.

The half-width measurements for the six sequential foils are also provided in FIG. 9. The half-width of the first foil (depth=0) was 1.5 cm. The half-widths measured for foils deeper in the target showed some increase with depth, for example the half-width for a foil at a depth of about 6 cm was about 3.3 cm. These half-width measurements demonstrate that the γ radiation beam, though spreading from scatter of γs within the target, remained sufficiently collimated to support the production of $Mo^{99}$ throughout a cross-section of the target without a significant loss of γ radiation energy from the target material.

EQUIVALENTS

While this invention has been particularly shown and described with references to preferred embodiments thereof, it will be understood by those skilled in the art that various changes in form and details may be made therein without departing from the spirit and scope of the invention as defined by the appended claims. Those skilled in the art will recognize or be able to ascertain using no more than routine experimentation, many equivalents to the specific embodiments of the invention described specifically herein. Such equivalents are intended to be encompassed in the scope of the claims.

What is claimed is:

1. An apparatus for sequentially producing a concentration of at least one product isotope by an isotopic conversion reaction, comprising:

a) a beam source for generating a photon beam along a beam axis, and b) a target assembly containing increments of target material displaced in-series along the beam axis, said increments including a targeted isotope which converts to the product isotope with irradiation by the photon beam, an increment of the target material proximal to the beam source being removable from the target assembly with product isotope while leaving target material which had been irradiated through the removed increment for further irradiation by the photon beam.

2. An apparatus of claim 1 wherein the intensity of the photon beam is at least 50 microamps/$cm^2$.

3. An apparatus of claim 1 wherein $$f \cdot R \geqq 2.2 \times 10^{-8}\ sec^{-1}$$

where f is the isotopic fraction of molybdenum-100 in the molybdenum-100 target, and R is the photon path length per unit volume per unit energy, weighted by the photoneutron cross-section integrated over energy.

4. An apparatus of claim 3 further comprising a means for moving target material increments, in series, toward the photon beam source as the proximal target increment, containing product isotope, is removed from the target assembly.

5. An apparatus of claim 4 further comprising a means for inserting an additional target material increment into the target assembly distal to the photon beam generating means.

6. An apparatus of claim 3 wherein the target material is in a solid mass.

7. An apparatus of claim 3 wherein the target material is in a form selected from the group consisting of a liquid, a slurry or particles.

8. An apparatus of claim 7 wherein each increment of target material is separately contained within a container.

9. An apparatus of claim 3 wherein the beam source includes:

a) an electron accelerator, and b) a convertor for converting an electron beam into the photon beam.

10. An apparatus of claim 9 wherein the convertor includes as least two separate convertor plates, disposed within the convertor, wherein the convertor plates have different thicknesses.

11. An apparatus of claim 10 further comprising a means for cooling the convertor, wherein said cooling means includes coolant channels disposed between adjacent convertor plates.

12. An apparatus of claim 2 wherein the photon beam has photons of energy of at least 8 MeV.

13. A method for sequentially producing a concentration of at least one product isotope by an isotopic conversion reaction, comprising the steps of:

a) directing a photon beam along a beam axis from a photon beam source through target material increments displaced in-series along the axis of the photon beam, a targeted isotope contained within the increments being exposed to said photon beam to form the product isotope within a target material increment proximal to said photon beam source and an increment behind the proximal increment, b) removing a first target material increment proximal to the photon beam source from the photon beam, and c) advancing the target material increments in-series toward the photon beam source.

14. A method of claim 13 wherein:

a) The target is molybdenum, and b) $f \cdot R \geqq 2.2 \times 10^{-8}\ sec^{-1}$, where f is the isotopic function of molybdenum-100 in the molybdenum target, and R is the photon path length per unit volume per unit energy, weighted by the photoneutron cross-section integrated over energy.

15. A method of claim 13 wherein the intensity of the photon beam is at least 50 microamps/$cm^2$.

16. A method of claim 15 wherein the photon beam has photons or energy of at least 8 MeV.

* * * * *